US012805619B2

(12) United States Patent
Radulescu et al.

(10) Patent No.: US 12,805,619 B2
(45) Date of Patent: Nov. 24, 2026

(54) PIVOT-OPEN CONTAINER HAVING AN OPENING ANGLE DELIMITATION

(71) Applicant: RIMOWA GmbH, Cologne (DE)

(72) Inventors: Cosmin Radulescu, Cologne (DE); Calin Pitea, Pulheim (DE); Francisco Naranjo, Cologne (DE)

(73) Assignee: RIMOWA GmbH, Cologne (DE)

( * ) Notice: Subject to any disclaimer, the term of this patent is extended or adjusted under 35 U.S.C. 154(b) by 18 days.

(21) Appl. No.: 19/074,570

(22) Filed: Mar. 10, 2025

(65) Prior Publication Data

US 2025/0325081 A1 Oct. 23, 2025

(30) Foreign Application Priority Data

Mar. 14, 2024 (DE) ..... 10 2024 107 233.4

(51) Int. Cl.
*A45C 13/02* (2006.01)

(52) U.S. Cl.
CPC ..... *A45C 13/02* (2013.01)

(58) Field of Classification Search
CPC ..... A45C 13/02
USPC ..... 190/119
See application file for complete search history.

(56) References Cited

U.S. PATENT DOCUMENTS

| | | | | |
|---|---|---|---|---|
| 6,145,661 | A | 11/2000 | Jung | |
| 8,720,681 | B1 | 5/2014 | Hancock et al. | |
| 9,848,682 | B2 * | 12/2017 | Zadvinskis | A45C 13/103 |
| 2005/0185916 | A1 | 8/2005 | Jost et al. | |

FOREIGN PATENT DOCUMENTS

| | | | |
|---|---|---|---|
| DE | 957526 | C | 2/1957 |
| DE | 1757409 | A1 | 7/1971 |
| EP | 4154754 | A1 | 3/2023 |

* cited by examiner

*Primary Examiner* — Nathan J Jenness
*Assistant Examiner* — Jessica Kavini Tamil
(74) *Attorney, Agent, or Firm* — Dickinson Wright PLLC

(57) ABSTRACT

A container having at least two frame elements circumferentially surrounding an internal receptacle space for receiving objects that are connected to one another and pivotable about pivot axis X from a closed to open state, wherein a maximum opening angle of the frame elements is delimited by means of at least one foldable connecting element that has at least two connecting means and holding parts. Each frame element has on an internal wall, on lateral portions extending radially to the pivot axis, a mating connecting means releasably connecting to the connecting means, and a mating holding part releasably connecting to the holding parts. The connecting means are movable parallel to the pivot axis in order to connect to the mating connecting means. The holding parts are movable radially to the pivot axis in order to connect to the mating holding parts.

20 Claims, 4 Drawing Sheets

PIVOT-OPEN CONTAINER HAVING AN OPENING ANGLE DELIMITATION

CROSS REFERENCE TO RELATED APPLICATIONS

This application claims the benefit of priority under 35 U.S.C. § 119 to German Patent Application No. 10 2024 107 233.4, filed Mar. 14, 2024, the content of which is incorporated herein by reference in its entirety.

FIELD

The invention relates to a container such as, for example, a bag or a case. Furthermore, the invention relates to a connecting element for use in a container of the type mentioned above, and to a connecting element group having two connecting elements of this type.

BACKGROUND

The statements in this section merely provide background information related to the present disclosure and several definitions for terms used in the present disclosure and may not constitute prior art.

Containers are available in the form of briefcases or document cases, or also handbags. Frame elements per se are typically designed as case shells, or form a framework for stabilizing in particular flexible, often textile, case shells. The containers herein have connecting elements which delimit the maximum opening angle, wherein the two frame elements are typically connected, i.e., sewn, to a substantially triangular textile as the connecting element, so as to delimit the maximum opening angle.

The known connecting elements can be releasably fastened to the respective lateral portions of the frame elements, wherein the respective connecting element is on one side fastened to a first lateral portion of the frame element, and on the other side fastened to the lateral portion of the respective other frame element, said lateral portion lying opposite the pivot axis to the lateral portion of the one frame element. Releasable connecting elements have the advantage that the container is more modular, in particular more adaptable. Also, in the event of damage to the respective connecting element, containers having releasable connecting elements are easier to repair, for example without having to open/sever seams or adhesive connections.

Releasable connections between the connecting element and the frame elements are in each case often provided by way of one connecting means and one mating connecting means. These connections are designed in particular as press stud connections or loop-and-hook fasteners. It is known that the connecting element having the connecting means has a first press stud connecting element or hook-and-loop fastener element, and the respective frame element has a corresponding mating connecting means, i.e., a second press stud connecting element or hook-and-loop fastener element. The connecting means is brought to engage with the mating connecting means by a movement parallel to the pivot axis, as a result of which the connecting element is connected to the frame element. Often, the connecting element is also connected to the frame element by a multiplicity of press stud connections or long hook-and-loop fastener strips.

Moreover, containers are known in which the maximum opening angle is set in that the two frame elements are connected, in particular sewn, to a substantially triangular textile.

Also known are combinations of connection types, so that the connecting element has connecting means as well as holding means. In this case, it is provided that the frame elements have corresponding mating holding means and mating connecting means. It is known that the holding means and the mating holding means are embodied as a hook-and-loop fastener, wherein the connecting means and the mating connecting means are embodied as press stud connections. Advantageously, in this known variant, a large adhesive surface is provided by means of the hook-and-loop fastener, and a high holding force is provided by means of the press stud connection.

It is furthermore known that two case shells which are pivotable open relative to one another about the pivot axis are in each case connected to one another by means of two connecting elements, so that in each case a first lateral portion of the first frame element is connected to a first lateral portion of the second frame element by means of a first connecting element, and a second lateral portion of the first frame element is connected to a second lateral portion of the second frame element by means of a second connecting element. In this variant, the connecting elements advantageously can conjointly function as a divider, owing to the fact that they are connected to one another parallel to the pivot axis.

However, in the known connecting elements it has been demonstrated that there is room for improvement in terms of assembling and/or in terms of resilience. In particular, a user is unable to assemble the known connecting elements on the frame elements by using one hand. Because the connecting means and the holding means in the containers are releasable from one another in an identical separating direction, which is oriented parallel to the pivot axis, the connections, in particular the combination of a press stud connection and a hook-and-loop fastener, can unintentionally be simultaneously released when exceeding a specific releasing force oriented parallel to the pivot axis. The consequence is typically that the mutual opening angle of the two frame elements is no longer delimited and the frame elements pivot open in an uncontrolled manner about the pivot axis. The unintentional release of the connecting elements is often associated with damage to the objects received in the receptacle space of the container, or the loss of said objects.

SUMMARY

An objective of the present disclosure is to make available a pivot-open container having an opening angle delimitation, which overcomes the disadvantages known from the conventional art. The pivot-open container of the present disclosure offers easier assembling and preferably a higher level of reliability in relation to unintentional releasing.

According to one aspect of the present disclosure, the objective is achieved by a container, in particular a bag or a case, having at least two frame elements which circumferentially surround an internal receptacle space for receiving objects and which are connected to one another on one side so as to be pivotable open about a pivot axis X from a closed state of the container to an opened state of the container. A maximum opening angle of the frame elements is delimited by means of at least one foldable connecting element. The connecting element for connecting to the frame elements has at least two connecting means and at least two holding parts, and the frame elements correspondingly have in each case on an internal wall, on lateral portions extending radially to the pivot axis X, at least one mating connecting means for releasably connecting to the connecting means of the connecting element, and at least one mating holding part for releasably connecting to the holding parts of the connecting element. In order to connect the connecting means to the respective mating connecting means, the connecting means are movable parallel to the pivot axis X to the respective corresponding mating connecting means. In order to connect the holding part to the respective mating holding part, the holding parts are movable radially to the pivot axis X to the respective corresponding mating holding part.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

In order that the disclosure may be well understood, there will now be described various forms thereof, given by way of example, reference being made to the accompanying drawings, in which:

FIG. 3 is assembled in a lateral portion on an internal wall of a frame element of the container.

Figure 1:
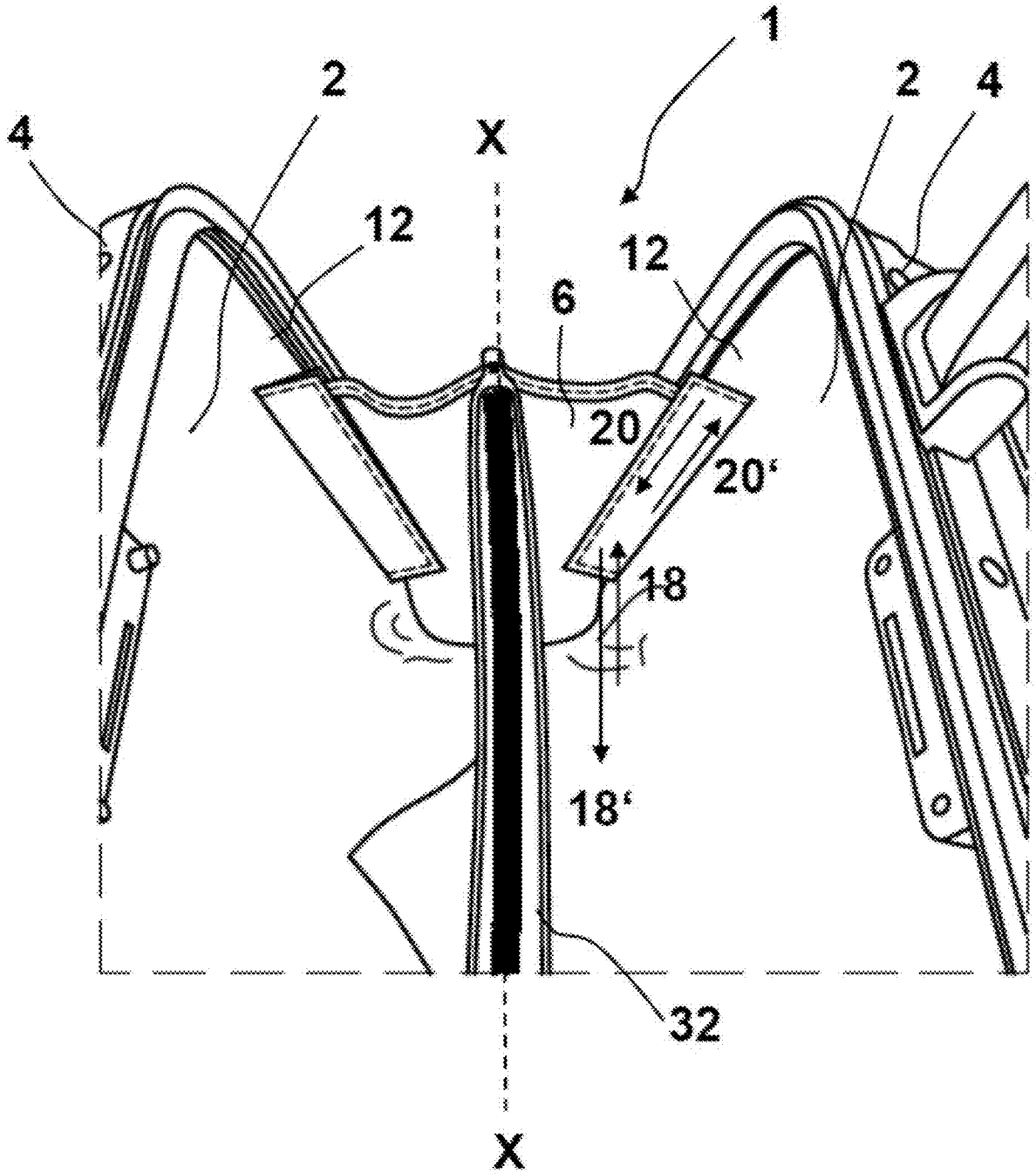
FIG. 1 shows a perspective view of a variant of a container in an opened state, having a first embodiment of a connecting element.

The drawings are provided herewith for purely illustrative purposes and are not intended to limit the scope of the present invention.

DETAILED DESCRIPTION

The following description is merely exemplary in nature and is in no way intended to limit the present disclosure or its application or uses. It should be understood that throughout the description, corresponding reference numerals indicate like or corresponding parts and features.

The present disclosure generally provides a container such as, for example, a bag or a case. The container has at least two frame elements which circumferentially surround an internal receptacle space for receiving objects. The frame elements are connected to one another on one side so as to be pivotable open about a pivot axis from a closed state of the container to an opened state of the container. A maximum opening angle of the frame elements is delimited by means of at least one connecting element. For connecting the connecting element to the frame elements, the connecting element has at least two connecting means and at least two holding parts. The frame elements correspondingly have in each case on an internal wall, on lateral portions extending radially to the pivot axis, at least one mating connecting means for releasably connecting to the connecting means of the connecting element, and at least one mating holding part for releasably connecting to the holding parts of the connecting element. It is provided that for connecting the connecting means to the respective mating connecting means, the connecting means are movable parallel to the pivot axis to the respective corresponding mating connecting means.

Owing to the fact that, for connecting the holding part to the respective mating holding part, the holding parts are movable radially to the pivot axis to the respective corresponding mating holding part, assembly of the connecting element to the respective lateral portion of the frame element can advantageously be implemented by using one hand. Furthermore, the combination of two directions of movement dispenses with a change of grip. Preferably, the user can hold a corresponding portion of the connecting element with one hand and sequentially first move the connecting element radially to the pivot axis in such a way that the holding part is connected to the mating holding part by means of the movement radially to the pivot axis. Subsequently, the user can move the connecting element in such a manner, in particular without a change of grip, that the connecting means is moved parallel to the pivot axis and connects to the corresponding mating connecting means. For connecting the connecting means to the mating connecting means it can be provided that the connecting element can be pivoted about the connection between the mating holding part and the holding part, so that the connecting means is movable substantially parallel to the pivot axis.

A further advantage of the container of the present disclosure lies in that the holding part is releasable from the mating holding part by a first separating movement which is oriented radially to the pivot axis, whereas the connecting means is releasable from the mating connecting means by a second separating movement which is oriented parallel to the pivot axis. Therefore, the first separating movement and the second separating movement are not identically oriented, so that the risk of unintentional releasing by a releasing force acting in a specific direction, in particular a releasing force oriented parallel to the pivot axis, is prevented/minimized.

It lies within the scope of the present disclosure that the container can be designed as a case, as a bag, in particular a handbag. The container is also not restricted to any specific embodiments of the aforementioned, e.g., as a hard-top case.

The frame elements per se are preferably designed as case shells or connected integrally to a hard or flexible case shell. It also lies within the scope of the present disclosure that the frame elements are designed in such a manner that they provide a framework for stabilizing in particular flexible, often textile, case shells.

In an advantageous embodiment of the present disclosure, the mating holding part is designed as a latching tongue which extends radially from the pivot axis, so as to face away from the latter, to a free end. Correspondingly, the holding part which is correspondingly formed on the connecting element is designed as a receptacle sleeve of corresponding design. In this variant, the connection between the holding part and the mating holding part is advantageously established in that the receptacle sleeve is designed to be able to be plugged onto the latching tongue radially to the pivot axis. The receptacle sleeve preferably has a closed annular profile, this having the particular advantage that the holding part is blocked in a form-fitting manner in relation to releasing forces which act perpendicularly to the latching tongue extending radially to the pivot axis. This advantageously prevents unintentional releasing.

It can be provided in particular that the receptacle sleeve has an internal diameter which is adapted to the latching tongue in such a manner that for disposing the receptacle sleeve on the latching tongue, or the latching tongue in the receptacle sleeve, a flaring force which is able to be generated manually is required so that the receptacle sleeve is held on the latching tongue in a force-fitting manner too.

Additionally or alternatively, it can be provided that the connection between the connecting means and the mating connecting means supports the connection of the holding part, in particular of the receptacle sleeve, to the mating holding part, in particular the latching tongue, and/or restricts the movement of the holding part in such a manner that the holding part cannot be released from the mating holding part as long as the connecting means is connected to the mating connecting means.

In particular, the flaring force and the force-fitting connection of the receptacle sleeve on the latching tongue and/or the support and/or restricted movement of the connection between the connecting means and the mating connecting means prevent in an alternative variant, according to which the latching tongue extends radially from the pivot axis, so as to face the latter, to a free end, that the receptacle sleeve is separated from the latching tongue due to gravity.

It lies within the scope of the present disclosure that the connecting means is preferably releasably connected to the respective mating connecting means of corresponding design in a form-fitting manner, in particular by means of a hook-and-loop fastener, or in a force-fitting manner or in a force-fitting and form-fitting manner, in particular by means of a threaded connection, preferably by means of a latching connection, for example a press stud connection.

The production of the container is preferably simplified in that one mating connecting means and one mating holding part are in each case disposed on a common assembly plate. The assembly plate can expediently be disposed/able to be disposed on the internal circumferential wall in the lateral portion of the frame element. The variant has the advantage that the disposal of the mating holding part relative to the mating connecting means can take place independently of the frame part, this simplifying the assembling, in particular in terms of an accessibility of the respective elements, on the one hand. The assembly plate can in turn be screwed to the frame element and/or be attached to the latter in a materially integral manner, in particular be adhesively bonded thereto.

The production and assembly reliability can moreover be further improved in that, according to an advantageous variant, at least the mating holding part is formed monolithically in one piece with the assembly plate. In particular, the mating holding part as the latching tongue is formed in a materially integral manner conjointly with the assembly plate, in particular produced by a stamping-and-bending method.

The connecting means is preferably adapted to the respective maximum opening angle of the two frame elements. Owing to the fact that the connecting means, radially to the pivot axis, has in particular a triangular or trapezoidal, particularly preferably a symmetrical trapezoidal, section, the connecting means can particularly efficiently fill or close a substantially V-shaped gap which widens towards the pivot axis when opening the frame elements.

According to an advantageous variant of the container, the container has two connecting elements which are disposed so as to be axially offset from the pivot axis and connect in each case two frame elements disposed opposite to the pivot axis to one another. The four frame elements and the two connecting elements are in particular embodied, or connected to one another, according to one of the previous exemplary embodiments. Both connecting elements delimit the same mutual maximum opening angle of the frame elements.

The use of two connecting elements moreover has the advantage that the maximum opening angle can be maintained even under increased stress, for example a great force acting in the circumferential direction about the pivot axis on the frame elements. As a result, the frame elements per se can in particular also be designed to be heavier or more solid, in particular for reasons of protection or design. A further advantage lies in that, in the opened state of the container, the frame elements do not twist relative to one another, and preferably assume an opening position which is mirror-symmetrical relative to the pivot axis. Mutual twisting of the frame elements due to internal stress can have a negative effect on the frame elements and/or on the connection, for example one or a plurality of joints, of the two frame elements in the region of the pivot axis.

In visual terms, the advantageous variant having two connecting elements provides that the two frame elements which are in each case able to be pivoted open about the pivot axis relative to one another are connected to one another by means of two connecting elements, so that in each case a first lateral portion of the first frame element is connected to a first lateral portion of the second frame element by means of the first connecting element, and a second lateral portion of the first frame element is connected to a second lateral portion of the second frame element by means of the second connecting element.

The two connecting elements are advantageously connected by means of at least one divider extending parallel to the pivot axis, in particular so as to form a connecting element group. It lies within the scope of the present disclosure that, according to an advantageous variant, the divider is able to be releasably disposed on the two connecting elements. The divider per se can advantageously be designed in such a manner that it fulfils various functional requirements. In particular, the divider can have pockets for receiving objects, expediently a register for sorting objects and/or documents, advantageously at least one compartment which is able to be closed by a zip fastener or a hook-and-loop fastener, preferably a pocket which is protected from NFC signals.

The container, in particular the frame elements and/or the connecting element and/or the divider, preferably has electrical installations such as a current accumulator for charging mobile apparatuses and/or a tracking installation, in particular a GPS sensor or a Bluetooth transmission installation, such as an Apple Airtag and/or any other type of anti-theft device.

The container expediently has a closure device, for example a keylock and/or a combination lock, which keeps the container in its locked state and deters unauthorized persons from opening the container.

In a particular variant of the present disclosure it is provided that the container has three frame elements, wherein two frame elements are in each case designed as a case shell, or as a framework for a case shell, and one frame element is designed as an intermediate member disposed between the case shells. The frame element designed as an intermediate member is in each case connected on opposite sides to one frame element so as to be pivotable about in each case one pivot axis, in the manner mentioned above.

Furthermore, one objective on which the present disclosure is based is achieved by means of a connecting element for delimiting a maximum opening angle of a container, in particular of a bag or a case, in particular of the type mentioned above. The connecting element according to the present disclosure has the features of the connecting element according to at least one of the above-mentioned embodiments.

Further advantageous design embodiments of the present disclosure are derived from the description of the figures hereunder. Identical parts are always provided with the same reference signs in the various figures of the drawing.

As In the context of the adjoining description it is claimed that the present disclosure is not restricted to the exemplary embodiments and thereby not to all or a plurality of features of combinations of features described; instead, each individual sub-feature of the/each exemplary embodiment is relevant to the subject matter of the present disclosure also independently of all other sub-features described in the same context, and also in combination with arbitrary features of any other exemplary embodiment.

Illustrated in FIG. 1 is a container 1 having at least two frame elements 2 which circumferentially surround an internal receptacle space for receiving objects. The container 1 illustrated in FIG. 1 is designed as a handbag, wherein the frame elements 2 are designed to be connected to two hard shells 4.

As is illustrated in FIG. 1, the frame elements 2 are connected to one another on one side so as to be pivotable open about a pivot axis X from a closed state of the container 1 (not illustrated) to an opened state of the container 1 illustrated in FIG. 1.

Figure 2:
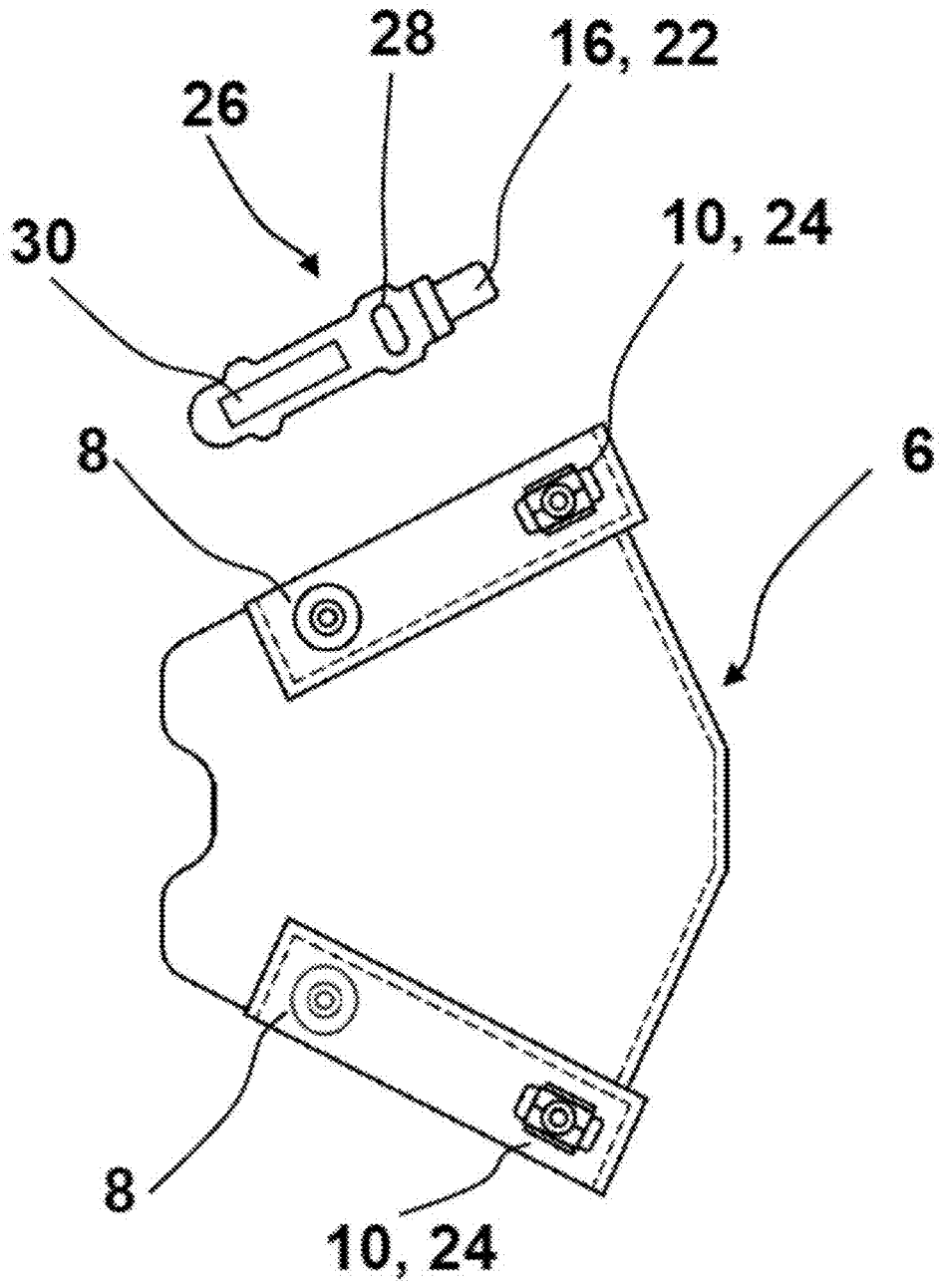
FIG. 2 shows a perspective view of a further embodiment of the connecting element, and a perspective view of a rear side of a variant of an assembly plate for disposal on a frame element.
Figure 3:
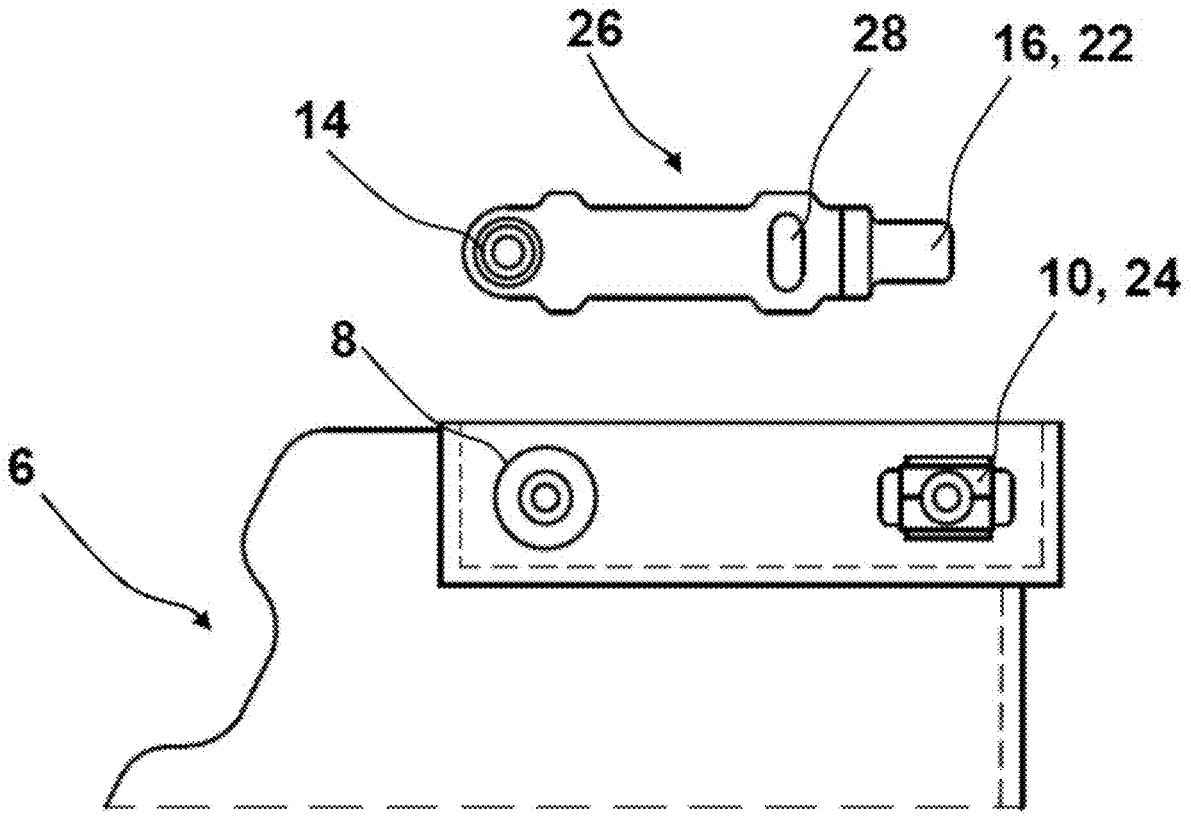
FIG. 3 shows a perspective view of a sub-region of the connecting element according to FIG. 2, and a perspective view of a front side of the assembly plate according to FIG. 2.

A maximum opening angle of the frame elements 2 is delimited by means of at least one connecting element 6 illustrated in FIG. 1, 2 or 3. The connecting element 6 is foldable, so that it folds down when closing the frame elements 2, or in the closed state of the container 1, respectively. The connecting element 6 is preferably produced from a textile and/or leather and/or imitation leather.

As is illustrated in FIG. 2, the connecting element 6 for connecting to the frame elements 2 has at least two connecting means 8 and at least two holding parts 10. The frame elements 2 correspondingly have in each case on an internal wall, on lateral portions 12 extending radially to the pivot axis X, at least one mating connecting means 14 for releasably connecting to the connecting means 8 of the connecting element 6, and at least one mating holding part 16 for releasably connecting to the holding parts 10 of the connecting element 6. The arrangement of the mating holding parts 16 and of the mating connecting means 14 is illustrated by way of example in a lateral portion 12 of a frame element 2 in FIG. 4.

For connecting the connecting means to the respective mating connecting means 14, the respective connecting means 8 are movable parallel to the pivot axis X to the respective corresponding mating connecting means 14. The direction of movement 18 for connecting the connecting means 8 to the mating connecting means 14 is identified in FIGS. 1 and 4. Correspondingly, the connecting means 8 for separating the connection is movable in the opposite direction parallel to the pivot axis X to the respective mating connecting means 14.

It is provided according to another aspect of the present disclosure that for connecting the holding part 10 to the respective mating holding part 16, the holding parts 10 are movable radially to the pivot axis X to the respective corresponding mating holding part 16. The direction of movement 20 for connecting the holding parts 10 to the mating holding parts 16 is identified in FIGS. 1 and 4. Correspondingly, the holding part 10 for separating the connection is movable in the opposite direction radially to the pivot axis X to the respective mating holding part 16.

It is advantageously illustrated in FIG. 1 that the direction of movement 20' of the holding part 10 for separating from the respective mating holding part 16 is aligned perpendicularly to the direction of movement 18' for separating the connecting means from the mating connecting means 14. Owing to this fact, a secure connection of the connecting element 6 to the respective frame elements 2 is made available in particular, and unintentional releasing is advantageously prevented.

Figure 4:
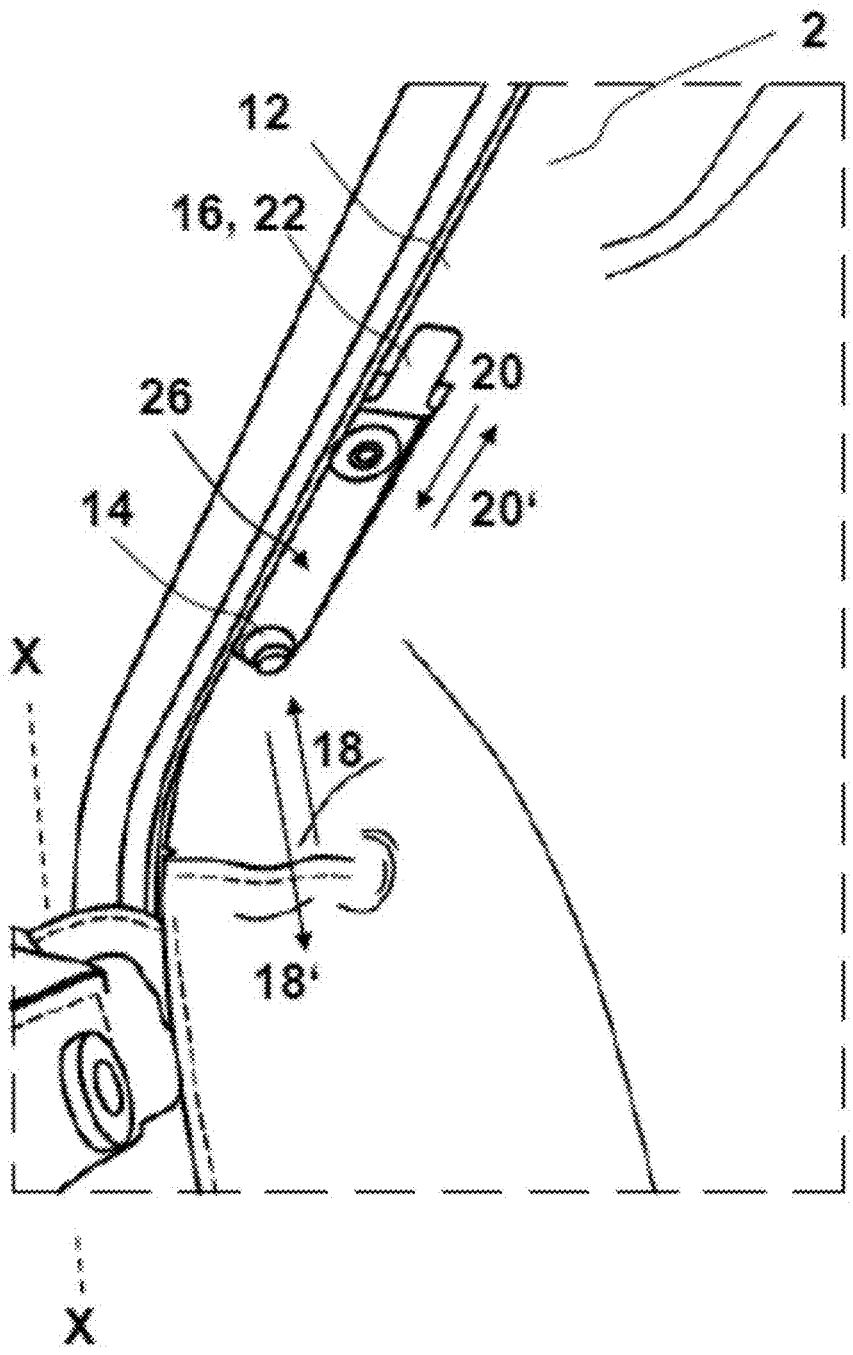
FIG. 4 shows a perspective view of a sub-region of a further variant of the container, having a released connecting element, wherein the assembly plate according to FIG. 2

According to the advantageous variants illustrated in FIGS. 2 to 4, the mating holding part 16 is designed as a latching tongue 22 which extends radially from the pivot axis X, so as to face away from the latter, to a free end, this being visualized in particular in FIG. 4. The holding part 10 is preferably designed as a receptacle sleeve 24 of corresponding design, wherein the receptacle sleeve 24 is designed to be able to be plugged onto the latching tongue 22 radially to the pivot axis X.

FIG. 3 shows a further preferred embodiment, according to which the connecting means 8 and the mating connecting means 14 are designed in a mutually corresponding manner as a latching connection, in particular as a press stud connection. In an example not illustrated, the respective connecting means 8 and the respective mating connecting means 14 of corresponding design are designed as a hook-and-loop fastener or a threaded connection.

A preferred embodiment of the present disclosure is illustrated in particular in FIGS. 2 to 4. According to this embodiment, one mating connecting means 14 and one mating holding part 16 are in each case disposed on a common assembly plate 26. The assembly plate 26 is preferably designed in such a manner that the latter, as is illustrated in FIG. 4, is disposed/able to be disposed on the internal circumferential wall in the lateral portion 12 of the frame element 2. The assembly plate 26 can expediently have an assembly bore 28 so that the assembly plate 26 can be screwed or riveted to the frame element 2, as is illustrated in FIG. 4. Alternatively or additionally, the assembly plate 26 can be fastened to the frame element 2 by means of a materially integral connection, in particular an adhesively bonded connection. An adhesive film 30, by means of which the assembly plate 26 can alternatively or additionally be fastened to the frame element 2, is preferably disposed on a rear side of the assembly plate 26 that points towards the frame element 2, as is illustrated in FIG. 2.

According to a preferred embodiment of the assembly plate 26, at least the mating holding part 16 is formed monolithically in one piece with the assembly plate 26. A particularly preferred variant of the assembly plate 26 is illustrated in FIGS. 2 to 4, wherein the assembly plate 26 is formed in a materially integral manner as a stamped-and-bent part so that the latter per se at one end forms the latching tongue 22 as the mating holding part 16.

A particular variant of embodiment of the connecting means provides that the connecting means 8, radially to the pivot axis X, has a triangular section, or a trapezoidal section as is illustrated in particular in FIGS. 1 and 2. A symmetrical trapezoidal section radial to the pivot axis X has proven to be particularly preferable.

According to a variant of the container 1 illustrated in FIG. 1, the container 1 has two connecting elements 6 which are disposed so as to be axially offset from the pivot axis X. Only one connecting element 6 is illustrated in FIG. 1. The connecting elements 6 connect in each case two frame elements 2, which are disposed so as to lie opposite one another relative to the pivot axis X, to one another. The four frame elements 2 and the two connecting elements 6 are preferably designed and connected to one another according to one of the previous embodiments.

When visualized, the advantageous variant having two connecting elements 6 provides that in each case the two frame elements 2 which are able to be pivoted open relative to one another about the pivot axis X are connected to one another by means of two connecting elements 6, so that in each case a first lateral portion 12 of the first frame element 2 is connected to a first lateral portion 12 of the second frame element 2 by means of the first connecting element 6, and a second lateral portion 12 of the first frame element 2 is connected to a second lateral portion 12 of the second frame element 2 by means of the second connecting element 6.

According to the variant of the container 1 illustrated in FIG. 1, a preferred variant lies in that two connecting elements 6 by means of a divider 32 extending parallel to the pivot axis X are preferably connected so as to form a connecting element group. An advantageous divider 32 having a pocket 34 is illustrated in FIG. 1. The divider 32 illustrated in FIG. 1 is fixedly connected to the two connecting elements 6, wherein according to a preferred alternative embodiment the divider 32 is able to be releasably disposed on both connecting elements 6.

The present disclosure is not restricted to the exemplary embodiments illustrated and described, but also comprises all embodiments which are functionally equivalent in the context of the invention. It is explicitly emphasized that the exemplary embodiments are not restricted to all features in combination; rather, each individual sub-feature can be relevant to the invention also independently of all other sub-features. Furthermore, the invention to date is also not restricted to the combination of specific features defined herein, but may also be defined by any arbitrary other combination of specific features of all individual features disclosed overall. This means that practically each individual feature can in principle be omitted, or be replaced by at least one individual feature disclosed elsewhere in the Present disclosure.

The invention claimed is:

1. A container having at least two frame elements which circumferentially surround an internal receptacle space for receiving objects, wherein the frame elements are connected to one another on one side so as to be pivotable open about a pivot axis (X) from a closed state of the container to an opened state of the container, wherein a maximum opening angle of the frame elements is delimited by means of at least one foldable connecting element, wherein the connecting element for connecting to the frame elements has at least two connecting means and at least two holding parts, and the frame elements correspondingly have in each case on an internal wall, on lateral portions extending radially to the pivot axis (X), at least one mating connecting means for releasably connecting to the connecting means of the connecting element, and at least one mating holding part for releasably connecting to the holding parts of the connecting element, wherein, for connecting the connecting means to the respective mating connecting means, the connecting means are movable parallel to the pivot axis (X) to the respective corresponding mating connecting means, wherein, for connecting the holding part to the respective mating holding part, the holding parts are movable radially to the pivot axis (X) to the respective corresponding mating holding part.

2. The container according to claim 1, wherein the mating holding part is designed as a latching tongue which extends radially from the pivot axis (X), so as to face away from the pivot axis (X), to a free end, and the holding part is designed as a receptacle sleeve of corresponding design, wherein the receptacle sleeve is designed to be able to be plugged onto the latching tongue radially to the pivot axis (X).

3. The container according to claim 1, wherein the connecting means is releasably connected to the respective mating connecting means in a form-fitting and/or force-fitting manner.

4. The container according to claim 1, wherein the connecting means and the mating connecting means are designed in a mutually corresponding manner as a latching connection or as a hook-and-loop fastener.

5. The container according to claim 1, wherein one mating connecting means and one mating holding part are in each case disposed on a common assembly plate, wherein the assembly plate is disposed/able to be disposed on the internal circumferential wall in the lateral portion of the frame element.

6. The container according to claim 1, wherein at least the mating holding part is formed monolithically in one piece with the assembly plate.

7. The container according to claim 1, wherein the connecting means, radially to the pivot axis (X), has a triangular or trapezoidal section.

8. The container according to claim 7, wherein the connecting means, radially to the pivot axis (X), is a symmetrical trapezoidal section.

9. The container according to claim 1, wherein the container has two connecting elements which are disposed so as to be axially offset from the pivot axis (X) and connect in each case two frame elements, disposed opposite one another relative to the pivot axis (X), to one another.

10. The container according to claim 1, wherein the two connecting elements are connected by means of at least one divider extending parallel to the pivot axis (X).

11. The container according to claim 10, wherein the divider is able to be releasably disposed on the two connecting elements.

12. The container according to claim 1, wherein the container has two connecting elements which are disposed so as to be axially offset from the pivot axis (X) and connect in each case two frame elements, disposed opposite one another relative to the pivot axis (X), to one another; wherein the container further comprises one of the following:

a) the connecting means is releasably connected to the respective mating connecting means in a form-fitting and/or force-fitting manner; or b) the connecting means and the mating connecting means are designed in a mutually corresponding manner as a latching connection or as a hook-and-loop fastener; or c) the connecting means, radially to the pivot axis (X), has a triangular or trapezoidal section.

13. The container according to claim 1, wherein the container has two connecting elements which are disposed so as to be axially offset from the pivot axis (X) and connect in each case two frame elements, disposed opposite one another relative to the pivot axis (X), to one another; wherein the container further comprises one of the following:

a) the mating holding part is designed as a latching tongue which extends radially from the pivot axis (X), so as to face away from the pivot axis (X), to a free end, and the holding part is designed as a receptacle sleeve of corresponding design, wherein the receptacle sleeve is designed to be able to be plugged onto the latching tongue radially to the pivot axis (X); or b) one mating connecting means and one mating holding part are in each case disposed on a common assembly plate, wherein the assembly plate is disposed/able to be disposed on the internal circumferential wall in the lateral portion of the frame element; or c) at least the mating holding part is formed monolithically in one piece with the assembly plate.

14. A connecting element that delimits a maximum opening angle of a container that has at least two frame elements which circumferentially surround an internal receptacle space for receiving objects and which are connected to one another on one side so as to be pivotable open about a pivot axis (X) from a closed state of the container to an opened state of the container, wherein the connecting element has at least two connecting means and at least two holding parts that are configured to releasably connect to the frame elements, which have corresponding mating connecting means and mating holding parts, wherein, the connecting means are movable parallel to the pivot axis (X) to the respective corresponding mating connecting means, and the holding parts are movable radially to the pivot axis (X) and to the respective corresponding mating holding part.

15. The connecting element according to claim 14, wherein the connecting element is configured to include one of the following features:

a) the connecting means is releasably connected to the respective mating connecting means in a form-fitting and/or force-fitting manner; or b) the connecting means and the mating connecting means are designed in a mutually corresponding manner as a latching connection or as a hook-and-loop fastener; or c) the connecting means, radially to the pivot axis (X), has a triangular or trapezoidal section.

16. A connecting element group for delimiting a maximum opening angle of a container, having two connecting elements according to claim 12, wherein the two connecting elements are connected by means of at least one divider extending parallel to the pivot axis (X).

17. The connecting element group according to claim 16, wherein the divider is able to be releasably disposed on the two connecting elements.

18. A connecting element group for delimiting a maximum opening angle of a container, having two connecting elements according to claim 11, wherein the two connecting elements are connected by means of at least one divider extending parallel to the pivot axis (X).

19. The connecting element group according to claim 18, wherein the divider is able to be releasably disposed on the two connecting elements.

20. The connecting element according to claim 14, wherein the mating holding part is designed as a latching tongue which extends radially from the pivot axis (X), so as to face away from the pivot axis (X), to a free end, and the holding part is designed as a receptacle sleeve of corresponding design, wherein the receptacle sleeve is designed to be able to be plugged onto the latching tongue radially to the pivot axis (X).

* * * * *